US009005373B2

(12) United States Patent
Starkbaum et al.

(10) Patent No.: US 9,005,373 B2
(45) Date of Patent: Apr. 14, 2015

(54) TREATMENT SOLUTION FOR PRODUCING CHROME AND COBALT-FREE BLACK CONVERSION COATINGS

(75) Inventors: Zdenek Starkbaum, Tanvald (CZ); Lukas Bedrnik, Tanvald (CZ); Kostantin Schwarz, Berlin (DE); Bjorn Dingwerth, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 631 days.

(21) Appl. No.: 13/394,362

(22) PCT Filed: Sep. 8, 2010

(86) PCT No.: PCT/EP2010/063178

§ 371 (c)(1), (2), (4) Date: Mar. 6, 2012

(87) PCT Pub. No.: WO2011/036058

PCT Pub. Date: Mar. 31, 2011

(65) Prior Publication Data

US 2012/0186702 A1 Jul. 26, 2012

(30) Foreign Application Priority Data

Sep. 23, 2009 (EP) ..... 09171140

(51) Int. Cl.
*C23C 22/34* (2006.01)
*C23C 22/53* (2006.01)

(52) U.S. Cl.
CPC ..... *C23C 22/34* (2013.01); *C23C 22/53* (2013.01)

(58) Field of Classification Search
USPC ..... 148/247
IPC ..... C23C 22/34,22/00
See application file for complete search history.

(56) References Cited

U.S. PATENT DOCUMENTS

| | | | |
|---|---|---|---|
| 5,091,223 | A | 2/1992 | Mori et al. |
| 2010/0133113 | A1 | 6/2010 | Krizova et al. |

FOREIGN PATENT DOCUMENTS

| | | |
|---|---|---|
| EP | 0405340 | 1/1991 |
| EP | 1970470 | 9/2008 |
| JP | 2005187838 | 7/2005 |

OTHER PUBLICATIONS

PCT/EP2010/063178; PCT International Search Report and Written Opinion of the International Searching Authority dated Nov. 11, 2010.

*Primary Examiner* — Weiping Zhu
(74) *Attorney, Agent, or Firm* — Renner, Otto, Boisselle & Sklar, LLP

(57) ABSTRACT

The invention relates to chromium- and cobalt-free treatment solutions for producing black coatings which afford corrosion protection. The treatment solution of the invention contains oxo cations or complex halogen ions or mixtures of oxo cations and complex halogen ions, an oxidant and an organic sulphur compound.

12 Claims, No Drawings

TREATMENT SOLUTION FOR PRODUCING CHROME AND COBALT-FREE BLACK CONVERSION COATINGS

The present application is a U.S. National Stage Application under 35 USC §371 of International Application No. PCT/EP2010/063178, filed 8 Sep. 2010, published as WO 2011/036058 on 31 Mar. 2011, which in turn claims priority to European Application No. 09171140.8, filed 23 Sep. 2009, the entirety of both of which are incorporated herein by reference.

BACKGROUND OF THE INVENTION

Various methods are available in the prior art for protecting metallic materials surfaces against corrosive environmental influences. Coating of the metallic workpiece to be protected with a coating of another metal, for example zinc and alloys thereof, is a widespread and established method in industry. To reduce corrosion of the coating metal or prevent it for as long as possible, use is often made of conversion layers, especially on cathodically protective base coating metals such as zinc and alloys thereof. These conversion layers are reaction products of the base coating metal or an alloy thereof with the reaction solution which are insoluble in aqueous media over a wide pH range. Examples of such conversion layers are phosphating layers and chromating layers.

In the case of chromating layers, the surface to be treated is dipped into an acidic solution containing chromium(VI) ions. If the surface in question is, for example, a zinc surface, part of the zinc dissolves. Under the reducing conditions which prevail here, chromium(VI) is reduced to chromium(III) which is precipitated as, inter alia, chromium(III) hydroxide or a sparingly soluble μ-oxo- or μ-hydroxo-bridged chromium(III) complex in the, inter alia, surface film which is more alkaline as a result of the evolution of hydrogen. Sparingly soluble zinc chromate(VI) is formed in parallel. Overall, a closed, impermeable conversion layer which protects very effectively against corrosive attack by electrolytes is formed on the zinc surface.

Chromium(VI) compounds have not only an acute toxicity but a high carcinogenic potential, so that a replacement for the processes associated with these compounds is necessary.

A large number of processes using various complexes of trivalent chromium compounds have now become established as a replacement for chromating processes using hexavalent chromium compounds.

As an alternative to processes based on trivalent chromium compounds, the prior art also describes processes which make recourse to other metals for building up a conversion layer. The patent application WO 2008/119675 describes treatment solutions for producing chromium- and cobalt-free conversion layers containing oxo cations and complex halogen ions which lead to colourless and slightly iridescent layers.

However, a disadvantage of these chromium- and cobalt-free conversion layers described in the prior art is that they have hitherto existed only in colours based on interference phenomena. This encompasses virtually transparent, bluish or coloured iridescent and yellowish layers.

Dyes as are also used in Cr(III)-based passivations can in principle also be used in the case of chromium-free conversion layers.

However, here as in the case of the Cr(III)-based conversion layers, there is, owing to the low layer thickness (≤500 nm), not sufficient absorption of the light reflected by the surface over all wavelengths of visible light for the colour to be perceived as black.

In the case of black-colouring processes on the basis of Cr(III)-containing conversion layers, a transition metal such as cobalt or iron is generally added as Co(II) or Fe(II) or Fe(III) to the passivation in order to produce finely divided, black pigments in situ in the conversion layer.

Treatment solutions for producing such black passivations are described, for example, in EP 1 970 470 A1. Such treatment solutions comprise nitrate ions and at least two different carboxylic acids in addition to $Cr^{3+}$ and $Co^{2+}$ ions.

Iron has the disadvantage that the corrosion protection of the system is significantly weakened by incorporation of iron-containing pigments.

Although cobalt allows systems having a better corrosion protection, it has the disadvantage of being not unproblematical from a health point of view under particular conditions.

The patent text JP 2005-206872 describes a $Cr^{6+}$ ion-free treatment solution for producing black passivations, which solution contains $Cr^{3+}$ ions together with at least one further ion selected from the group consisting of sulphate, chloride, ions of the oxo acids of chlorine and nitrate and also a sulphur compound. The black conversion layers produced in this way contain chromium ions.

The document JP 2005-187925 describes treatment solutions for producing coloured passivation layers containing $Cr^{3+}$ ions, further metal ions and an organic sulphur compound. The black conversion layers produced in this way contain chromium ions.

The document JP 2005-187838 likewise describes aqueous treatment solutions for producing black passivation layers, which solutions contain ions selected from at least Ni and Co and also a sulphur compound. The black conversion layers produced in this way contain nickel and/or cobalt ions.

OBJECT OF THE INVENTION

It is an object of the invention to provide reaction solutions and processes for increasing corrosion protection and for colouring zinc-containing surfaces black, which solutions are free of toxic metals such as chromium and cobalt.

A process which combines the ecological and occupational hygiene advantage of a chromium- and cobalt-free passivation with a decoratively high-quality black colour impression is therefore desirable.

DESCRIPTION OF THE INVENTION

The invention is based on the use of sulphur-containing compounds in an aqueous, acidic matrix which is free of chromium ions and cobalt ions. Such treatment solutions enable black conversion layers to be produced on zinc and alloys thereof.

The treatment solutions of the invention contain a) at least one complex, water-soluble metal cation selected from the group consisting of oxo cations of the formula $M'O_c^{d+}$, where c is an integer from 1 to 3 and d is an integer from 1 to 3, and complex halogen ions of the formula $M''X_a^{b-}$, where X is selected from the group consisting of F, Cl, Br and I, a is an integer from 3 to 6, b is an integer from 1 to 4 and M' and M'' are selected from the group consisting of Mn, V, Ti, W, Mo, Zr, B, Si and Al;

b) at least one oxidant selected from the group consisting of hydrogen peroxide, organic peroxides, alkali metal peroxides, perborates, persulphates, nitrates, organic nitro compounds, organic N-oxides and mixtures thereof;

c) at least one organic sulphur compound selected from the group consisting of compounds of the formulae (1) and (2)

$$HS—R^1—COOR^2 \quad (1)$$

$$R^5OOC—R^3—S—S—R^4—COOR^6 \quad (2),$$

where $R^1$ is selected from among C1-C8-alkyl, linear and branched, aryl, with preference being given to C1-C2-alkyl; $R^2$ is selected from among H, a suitable cation ($NH_4^+$, $Li^+$, $Na^+$, $K^+$) and C1-C4-alkyl, linear and branched;

$R^3$ and $R^4$ are selected independently from among C1-C8-alkyl, linear and branched, aryl, with the radicals $R^3$ and $R^4$ particularly preferably being identical and each being C1-C2-alkyl; and $R^5$ and $R^{6'}$ are selected independently from among H, a suitable cation ($NH_4^+$, $Li^+$, $Na^+$, $K^+$) and C1-C4-alkyl, linear and branched, with the radicals $R^5$ and $R^6$ preferably being identical.

Addition of suitable sulphur compounds of the formulae (1) and (2) enables a black coloration of the conversion layer to be achieved even in the absence of chromium, iron, cobalt and nickel. The list of compounds of this type is not exhaustive and includes, in particular, compounds which can liberate suitable compounds corresponding to the above formulae by hydrolysis or the like under the conditions of the solutions to be used for making up the reaction solution or under the conditions of the reaction solution or the reaction with the metal surface, for example the salts and esters of these compounds. The most preferred sulphur compounds are thioglycolic acid, 3-thiopropionic acid, dithiodiglycolic acid and thiolactic acid.

The sulphur compounds of the formulae (1) and (2) are added in an amount of from 0.2 g/l to 500 g/l, preferably from 1 g/l to 100 g/l and most preferably from 3 g/l to 20 g/l, to the treatment solution of the invention.

The oxo cations of the formula $M'O_c^{d+}$ are preferably added in the from of their nitrates, sulphates and halides, from which the oxo cations are formed by hydrolysis in the treatment solution, to the treatment solution of the invention. For example, zirconyl sulphate ($ZrO(SO_4)$) is used as source of $ZrO^2$.

Examples of suitable metals M' are Mn, V, W, Mo, Ti and Zr. Examples of suitable oxo cations are $MnO^+$, $VO^{3+}$, $VO^{2+}$, $WO_2^{2+}$, $MoO_2^{2+}$, $TiO^{2+}$, $ZrO^{2+}$ and mixtures thereof. Particularly preferred oxo cations are those of titanium and of zirconium. The oxo cations are added in an amount of from 0.02 g/l to 50 g/l, preferably from 0.05 g/l to 10 g/l and most preferably from 0.1 g/l to 5 g/l, to the treatment solution.

The complex halogen ions of the formula $M''X_a^{b-}$ are added in the form of their metal salts, preferably their alkali metal salts, particularly preferably their sodium and potassium salts. Preference is given to the complex halogen anions of the formula $M''X_a^{b-}$ selected from the group consisting of $BF_4^-$, $TiF_6^{2-}$, $ZrF_6^{2}$, $SiF_6^{2-}$, $AlF_6^{3-}$ and mixtures thereof. Particular preference is given to the complex halogen ions $SiF_6^{2-}$, $TiF_6^{2-}$ and $ZrF_6^{2-}$. The complex halogen anions of the formula $M''X_a^{b-}$ are added in an amount of from 0.02 g/l to 100 g/l, preferably from 0.05 g/l to 50 g/l and most preferably from 0.1 g/l to 10 g/l, to the treatment solution of the invention.

The treatment solution of the invention can contain either at least one oxo cation of the formula $M'O_c^{d+}$ where M' is Mn, V, Ti, W, Mo, Zr or at least one complex halogen ion of the formula $M''X_a^{b-}$. In a further embodiment of the invention, the treatment solution contains a mixture of both at least one oxo cation and at least one complex halogen ion. This embodiment is preferred since it results in increased corrosion resistance of the metal layer (cf. Examples 3 to 7).

The at least one oxidant in the treatment solution of the invention is selected from the group consisting of hydrogen peroxide, organic peroxides, alkali metal peroxides, persulphates, perborates, nitrates and mixtures thereof. The most preferred oxidant is hydrogen peroxide. The at least one oxidant is added in an amount of from 0.2 g/l to 100 g/l, preferably from 1 g/l to 50 g/l and most preferably from 5 g/l to 30 g/l, to the treatment solution.

In a further preferred embodiment of the treatment solution of the invention, the pH is adjusted by means of an acid or base to a value in the range from 0.5 to 5.0, preferably in the range from 1.0 to 3.0, particularly preferably in the range from 1.3 to 2.0. $HNO_3$ or $H_2SO_4$ is preferably used as acid, and sodium hydroxide is preferably used as base.

The treatment solution of the invention is used for producing corrosion protection layers by direct treatment of the metal surfaces with the treatment solution, by dipping the substrate to be coated into the treatment solution or flushing the substrate with the treatment solution. The use by dipping or flushing is preferably carried out at a temperature of the treatment solution in the range from 20 to 100° C., preferably from 30 to 70° C., more preferably from 40 to 60° C. and particularly preferably at about 50° C. The most suitable treatment time for producing corrosion protection layers by dipping or flushing of the substrate to be coated into or with the treatment solution varies as a function of various parameters, e.g. the composition of the treatment solution, the treatment temperature, the type of metal surface and the degree of desired corrosion protection, and can be determined by means of routine experiments. In general, the treatment time is in the range from 5 to 180 s, preferably in the range from 30 to 120 s.

The black conversion layers deposited in this way produce good corrosion protection based on the formation of zinc corrosion products on zinc-containing surfaces.

To achieve a further increase in the corrosion protection afforded by the black conversion layers produced, the conversion layers described can be subjected to conventional after-treatment processes. These include, for example, sealing by means of silicates, organofunctional silanes and nanosize $SiO_2$ and also polymer dispersions.

The sealing layers produced by the subsequent treatment improve the barrier action of the underlying conversion layer and thus additionally improve the corrosion protection afforded by the overall coating system.

EXAMPLES

Comparative Example 800 ml of a solution of 0.25% by weight of zirconyl sulphate is admixed with 13.6 g/l of potassium hexa-fluorotitanate while stirring and the mixture is stirred vigorously for 30 min. The solution is subsequently made up to 1000 ml. The solution is diluted in a ratio of 1:4 with water (1 l of solution+3 l of water) and subsequently added to 1 l of a hydrogen peroxide solution (10% by weight).

The pH is adjusted to pH 1.6 at 50° C. by means of NaOH.

A sheet of low-alloy steel is, after suitable pretreatment, coated with 10 μm of zinc in an alkaline zinc-plating electrolyte (Protolux® 3000, a product of Atotech Deutschland GmbH, containing 12 g/l of zinc and 120 g/l of NaOH).

After zinc-plating, the metal sheet is rinsed and dipped directly into the treatment solution prepared above. After a treatment time of 60 s with gentle agitation, the metal sheet is taken out, rinsed and dried. It has a multicoloured iridescent surface.

Example 1

A treatment solution as described in Comparative Example 1 for producing conversion layers is admixed with 10 g/l of thioglycolic acid and the pH is adjusted to pH 1.6 (50° C.) by means of NaOH.

A sheet of low-alloy steel is, after suitable pretreatment, coated with 8-15 μm of zinc in an alkaline zinc-plating electrolyte (Protolux® 3000, a product of Atotech Deutschland GmbH, containing 12 g/l of zinc and 120 g/l of NaOH).

After zinc-plating, the metal sheet is rinsed and dipped directly into the treatment solution prepared above. After a treatment time of 60 s with gentle agitation, the metal sheet is taken out, rinsed and dried. It has a deep-black surface.

Example 2

A treatment solution as described in Comparative Example 1 for producing conversion layers is admixed with 11 g/l of 3-thiopropionic acid and the pH is adjusted to pH 1.6 (50° C.) by means of NaOH.

A sheet of low-alloy steel is, after suitable pretreatment, coated with 10 μm of zinc in an alkaline zinc-plating electrolyte (Protolux® 3000).

After zinc-plating, the metal sheet is rinsed and dipped directly into the treatment solution prepared above. After a treatment time of 60 s with gentle agitation, the metal sheet is taken out, rinsed and dried. It has a deep-black surface.

Example 3

A treatment solution as described in Comparative Example 1 for producing conversion layers is admixed with 11 g/l of dithiodiglycolic acid and the pH is adjusted to pH 1.6 (50° C.) by means of NaOH.

A sheet of low-alloy steel is, after suitable pretreatment, coated with 10 μm of zinc in an alkaline zinc-plating electrolyte (Protolux® 3000).

After zinc-plating, the metal sheet is rinsed and dipped directly into the treatment solution prepared above. After a treatment time of 60 s with gentle agitation, the metal sheet is taken out, rinsed and dried. It has a deep-black surface.

The metal sheet with the surface produced in this way is dried at 80° C. in a convection oven for 15 min and the corrosion protection is tested in the neutral salt spray mist test in accordance with ISO 9227 NSS. The metal sheet withstood the test for 48 h until zinc corrosion products occurred on >5% of the area.

Example 4

A metal sheet having a surface produced according to Example 3 is rinsed, dipped into a sealing solution comprising a silicate-containing polyurethane dispersion (Corrosil® Plus 501, a product of Atotech Deutschland GmbH) and dried at 80° C. in a convection oven for 15 min. The corrosion protection was tested in the neutral salt spray mist test in accordance with ISO 9227 NSS. The metal sheet withstood the test for 120 h until zinc corrosion products occurred on >5% of the area. A sealing solution customarily used for increasing corrosion protection can thus also be used on the chromium- and cobalt-free black conversion layers according to the invention.

Example 5

A treatment solution as described in Comparative Example 1 for producing conversion layers is admixed with 13 g/l of thiolactic acid and the pH is adjusted to pH 1.6 (50° C.) by means of NaOH.

A sheet of low-alloy steel is, after suitable pretreatment, coated with 10 μm of zinc in an alkaline zinc-plating electrolyte (Protolux® 3000).

After zinc-plating, the metal sheet is rinsed and dipped directly into the treatment solution prepared above. After a treatment time of 60 s with gentle agitation, the metal sheet is taken out, rinsed and dried. It has a deep-black surface.

The metal sheet with the surface produced in this way is dried at 80° C. in a convection oven for 15 min and the corrosion protection is tested in the neutral salt spray mist test in accordance with ISO 9227 NSS. The metal sheet withstood the test for 48 h until zinc corrosion products occurred on >5% of the area.

Example 6

1000 ml of a solution of 3.5 g/l of potassium hexa-fluorotitanate are admixed with 250 ml of a hydrogen peroxide solution (10% by weight) while stirring and 10 g/l of thioglycolic acid are added.

The pH is adjusted to pH 1.6 at 50° C. by means of $HNO_3$.

A sheet of low-alloy steel is, after suitable pretreatment, coated with 10 μm of zinc in an alkaline zinc-plating electrolyte (Protolux® 3000).

After zinc-plating, the metal sheet is rinsed and dipped directly into the treatment solution prepared above. After a treatment time of 60 s with gentle agitation, the metal sheet is taken out, rinsed and dried. It has a deep-black surface.

The metal sheet with the surface produced in this way is dried at 80° C. in a convection oven for 15 min and the corrosion protection is tested in the neutral salt spray mist test in accordance with ISO 9227 NSS. The metal sheet withstood the test for 24 h until zinc corrosion products occurred on >5% of the area.

Example 7

1000 ml of a solution of 2.5 g/l of zirconyl sulphate are admixed with 250 ml of a hydrogen peroxide solution (10% by weight) while stirring and 10 g/l of thioglycolic acid are added.

The pH is adjusted to pH 1.6 at 50° C. by means of NaOH.

A sheet of low-alloy steel is, after suitable pretreatment, coated with 10 μm of zinc in an alkaline zinc-plating electrolyte (Protolux® 3000).

After zinc-plating, the metal sheet is rinsed and dipped directly into the treatment solution prepared above. After a treatment time of 60 s with gentle agitation, the metal sheet is taken out, rinsed and dried. It has a deep-black surface.

The metal sheet with the surface produced in this way is dried at 80° C. in a convection oven for 15 min and the corrosion protection is tested in the neutral salt spray mist test in accordance with ISO 9227 NSS. The metal sheet withstood the test for 24 h until zinc corrosion products occurred on >5% of the area.

The invention claimed is:

1. Treatment solution for producing black chromium- and cobalt-free conversion layers, which contains a) at least one complex, water-soluble metal cation selected from the group consisting of oxo cations of the formula $M'O_c^{d+}$, where c is an integer from 1 to 3 and d is an integer from 1 to 3, and/or complex halogen ions of the formula $M''X_a^{b-}$, where X is selected from the group consisting of F, Cl, Br and I, a is an integer from 3 to 6, b is an integer from 1 to 4 and M' and M'' are selected from the group consisting of Mn, V, Ti, W, Mo, Zr, B, Si and Al b) at least one oxidant c) at least one organic sulphur compound selected from the group consisting of compounds of the formulae (1) and (2)

$$HS—R^1—COOR^2 \quad (1)$$

$$R^5OOC—R^3—S—S—R^4—COOR^6 \quad (2),$$

where $R^1$ is selected from among C1-C8-alkyl, linear and branched, and aryl;

$R^2$ is selected from the group consisting of H, $NH_4^+$, $Li^+$, $Na^+$, $K^+$ and C1-C4-alkyl, linear and branched;

$R^3$ and $R^4$ are selected independently from the group consisting of C1-C8-alkyl, linear and branched and aryl; and $R^5$ and $R^6$' are selected independently from the group consisting of H, $NH_4^+$, $Li^+$, $Na^+$, $K^+$ and C1-C4-alkyl, linear and branched.

2. Treatment solution according to claim 1, wherein M' is selected from the group consisting of Mn, V, Ti, W, Mo and Zr.

3. Treatment solution according to claim 1, wherein M'' is selected from the group consisting of B, Al, Si, Ti and Zr.

4. Treatment solution according to claim 1, which contains at least one oxo cation of the formula $M'O_c^{d+}$ and at least one complex halogen ion of the formula $M''X_a^{b-}$.

5. Treatment solution according to claim 1, wherein the oxidant is selected from the group consisting of hydrogen peroxide, organic peroxides, alkali metal peroxides, perborates, persulphates, nitrates, organic nitro compounds and organic N-oxixes and mixtures thereof.

6. Treatment solution according to claim 1, wherein the radicals of the compounds of the formulae (1) and (2) are selected from among:

$R^1$ is C1-C2-alkyl and $R^3$ and $R^4$ are selected independently from among C1-C2-alkyl.

7. Original) Treatment solution according to claim 6, wherein $R^3$ and $R^4$ are identical.

8. Treatment solution according to claim 1, wherein the organic sulphur compound is selected from the group consisting of thioglycolic acid, dithiodiglycolic acid, thiolactic acid and 3-thiopropionic acid.

9. Treatment solution according to claim 1, wherein the oxidant is a peroxide.

10. Treatment solution according to claim 9, wherein the peroxide is hydrogen peroxide.

11. Treatment solution according to claim 1, wherein the at least one oxo cation of the formula $M'O_c^{d+}$ is selected from the group consisting of $MnO^+$, $VO^{3+}$, $VO^{2+}$, $WO_2^{2+}$, $MoO_2^{2+}$, $TiO^{2+}$, $ZrO^{2+}$ and mixtures thereof.

12. Treatment solution according to claim 1, wherein the at least one complex halogen ion of the formula $M'X_a^{b-}$ is selected from the group consisting of $SiF_6^{2-}$, $TiF_6^{2-}$ and $ZrF_6^{2-}$.

* * * * *